US011719040B2

(12) United States Patent
Fischer

(10) Patent No.: US 11,719,040 B2
(45) Date of Patent: Aug. 8, 2023

(54) DOOR COMPRISING A GUIDE ARRANGEMENT

(71) Applicant: Seuster KG, Lüdenscheid (DE)

(72) Inventor: Jörg Fischer, Dortmund (DE)

(73) Assignee: Seuster KG, Lüdenscheid (DE)

( * ) Notice: Subject to any disclaimer, the term of this patent is extended or adjusted under 35 U.S.C. 154(b) by 288 days.

(21) Appl. No.: 17/045,145

(22) PCT Filed: Apr. 2, 2019

(86) PCT No.: PCT/EP2019/058221
§ 371 (c)(1),
(2) Date: Oct. 2, 2020

(87) PCT Pub. No.: WO2019/192976
PCT Pub. Date: Oct. 10, 2019

(65) Prior Publication Data

US 2021/0148166 A1 May 20, 2021

(30) Foreign Application Priority Data

Apr. 5, 2018 (DE) ..... 202018101842.6
Mar. 18, 2019 (DE) ..... 202019101520.9

(51) Int. Cl.
*E06B 9/58* (2006.01)
*E06B 9/15* (2006.01)

(52) U.S. Cl.
CPC ..... *E06B 9/582* (2013.01); *E06B 9/15* (2013.01); *E06B 2009/1577* (2013.01); *E06B 2009/587* (2013.01)

(58) Field of Classification Search
CPC ..... E06B 2009/0684; E06B 2009/1505; E06B 2009/1511; E06B 2009/1533;
(Continued)

(56) References Cited

U.S. PATENT DOCUMENTS 649,729 A * 5/1900 Isbills ..... A47H 15/04 16/95 DW
2,655,683 A * 10/1953 McKee ..... E05D 15/242 16/104
(Continued)

FOREIGN PATENT DOCUMENTS

DE 3619516 A1 12/1987
DE 102006061180 A1 * 6/2008 ..... E06B 9/15
(Continued)

OTHER PUBLICATIONS

Kresmer, English translation of "DE102006061180." (Year: 2008).*
(Continued)

*Primary Examiner* — Johnnie A. Shablack
(74) *Attorney, Agent, or Firm* — Schwabe, Williamson & Wyatt, P.C.

(57) ABSTRACT

The invention relates to a door comprising a door leaf (10) which can be moved between an open position and a closed position and a guide arrangement for guiding the movement of the door leaf along a predefined path between the open position in the closed position, wherein the guide arrangement has at least one guide web (100) which is arranged fixedly with respect to a wall opening, extends at least along a portion of the predetermined path, and has two outer boundary surfaces (102, 104) and at least two guide devices (32, 34) which are fastened to the door leaf (10), wherein a first outer boundary surface (102) of the guide web (100) forms a surface for a first guide device (32) and the second outer boundary surface (104) of the guide web (100) forms a second guide surface (104) for a second guide device (34). Magnetic devices (1000, 1010, 1100) can be arranged on the door leaf and on the guide bar for guiding in a contactless manner.

14 Claims, 16 Drawing Sheets

(58) Field of Classification Search
CPC ..... E06B 2009/1538; E06B 2009/1544; E06B 2009/1577; E06B 2009/1583; E06B 2009/1594; E06B 2009/587; E06B 9/15; E06B 9/08; E06B 9/11; E06B 9/13; E06B 9/58; E06B 9/581; E06B 9/582; E05D 15/16; E05D 15/165; E05D 15/18; A47H 15/02; A47H 15/04
See application file for complete search history.

(56) References Cited

U.S. PATENT DOCUMENTS

| | | | | | |
|---|---|---|---|---|---|
| 3,076,499 | A * | 2/1963 | Zoll | E06B 9/15 | 160/133 |
| 3,076,500 | A * | 2/1963 | Zoll | E06B 9/15 | 160/236 |
| 3,772,129 | A * | 11/1973 | Dover | E06B 9/15 | 264/46.7 |
| 4,102,007 | A * | 7/1978 | Janson | A47H 1/104 | 16/96 R |
| 4,285,095 | A * | 8/1981 | Janson | E05D 15/0652 | 52/837 |
| 4,947,937 | A * | 8/1990 | Searer | E06B 9/68 | 160/133 |
| 4,972,894 | A * | 11/1990 | Machill | E06B 9/17 | 160/235 |
| 4,993,328 | A * | 2/1991 | Wendt | F16C 13/006 | 384/140 |
| 5,063,636 | A * | 11/1991 | Dickson | E06B 9/04 | 16/98 |
| 5,253,694 | A * | 10/1993 | Bernardo | E06B 9/581 | 160/133 |
| 5,484,007 | A * | 1/1996 | Rejc | E06B 9/15 | 160/133 |
| 5,488,982 | A * | 2/1996 | Rejc | E06B 9/15 | 160/310 |
| 5,740,641 | A * | 4/1998 | Oxnard | E06B 3/485 | 52/234 |
| 5,836,499 | A * | 11/1998 | Mullet | B29C 33/36 | 226/182 |
| 5,857,510 | A * | 1/1999 | Krupke | E05D 15/242 | 160/187 |
| 6,035,918 | A * | 3/2000 | Kraeutler | E06B 9/13 | 160/267.1 |
| 6,123,139 | A * | 9/2000 | Kalempa | E05D 15/165 | 160/133 |
| 6,672,362 | B1 * | 1/2004 | Mullet | E05F 15/686 | 16/96 L |
| 8,899,297 | B2 * | 12/2014 | Mazej | E06B 9/70 | 160/310 |
| 9,347,257 | B2 * | 5/2016 | Letonje | E06B 9/68 | |
| 9,945,178 | B2 * | 4/2018 | Hentschel | E06B 9/581 | |
| 10,190,362 | B2 * | 1/2019 | Fischer | E06B 9/0638 | |
| 10,844,656 | B2 * | 11/2020 | Motosko | E04H 9/14 | |
| 10,914,117 | B2 * | 2/2021 | Rejc | E05F 15/684 | |
| 11,162,301 | B2 * | 11/2021 | Ouyang | E06B 9/17061 | |
| 2005/0081737 | A1 * | 4/2005 | Smallwood | B60J 5/14 | 104/89 |
| 2007/0277941 | A1 * | 12/2007 | Jansen | E06B 9/13 | 160/271 |
| 2007/0277943 | A1 * | 12/2007 | Boerger | E06B 9/581 | 160/273.1 |
| 2008/0251220 | A1 * | 10/2008 | Rejc | E06B 9/62 | 160/266 |
| 2010/0218431 | A1 * | 9/2010 | Hardison, III | E06B 9/58 | 49/475.1 |
| 2010/0251622 | A1 | 10/2010 | Helfer | | |
| 2018/0258692 | A1 * | 9/2018 | Conway | E06B 7/18 | |
| 2020/0131845 | A1 * | 4/2020 | Fischer | E06B 9/13 | |
| 2021/0148166 | A1 * | 5/2021 | Fischer | E06B 9/582 | |

FOREIGN PATENT DOCUMENTS

| | | | | |
|---|---|---|---|---|
| DE | 102009017767 | A1 | 10/2010 | |
| EP | 1241310 | A1 | 9/2002 | |
| EP | 3176355 | A1 | 6/2017 | |
| WO | WO-2015077054 | A1 * | 5/2015 | E06B 9/0638 |
| WO | WO-2019150270 | A1 * | 8/2019 | E06B 9/0646 |

OTHER PUBLICATIONS

International Search Report dated Oct. 10, 2019 for International Application No. PCT/EP2019/058221, 2 pages.
International Preliminary Report on Patentability dated Jul. 16, 2020 for International Application No. PCT/EP2019/058221, 5 pages.

* cited by examiner a)

b)

c)

d)

a)

b)

c)

d)

a)

b)

c)

d)

c)

d)

a)

b)

c)

d)

e)

f)

DOOR COMPRISING A GUIDE ARRANGEMENT

CROSS REFERENCE TO RELATED APPLICATION

The present application is a 35 U.S.C. § 371 national phase entry application of, and claims priority to, International Patent Application No. PCT/EP2019/058221, filed Apr. 2, 2019, which claims priority to German Patent Application No. DE 202018101842.6, filed Apr. 5, 2018, and DE 202019101520.9, filed Mar. 18, 2019 the disclosures of which are hereby incorporated by reference in their entirety for all purposes.

BACKGROUND

The invention relates to a door comprising a door leaf movable between an open position, in which it at least partially uncovers a wall opening, and a closed position, in which it at least partially closes the wall opening, and a guide arrangement for guiding the door leaf movement along at least a section of a predetermined path between the open position and the closed position.

Such doors can be implemented in the form of so-called sectional doors, in which the door leaf is arranged overhead approximately in a horizontal plane in the open position. In such sectional doors, the door leaf consists of a plurality of door leaf elements articulated with one another with respect to joint axes extending perpendicularly to the predetermined path. A door leaf movement is thus enabled in which the door leaf passes through a curved section of a predetermined path.

In another embodiment of doors of the type described at the outset, the door leaf is wound up in the open position into a multilayered coil. In such rollup doors, the door leaf can be formed as a whole from a flexible material, such as a plastic film. Guide rollers can be used to guide the door leaf movement, which are attached to stabilizing devices extending perpendicularly to the lateral edges of the door leaf. For this purpose, the stabilizing devices can be coupled to joint arrangements arranged in the region of the lateral edges of the door leaf and fastened on the door leaf, which can, on the other hand, be equipped with guide rollers for guiding the door leaf movement. Such doors are specified in EP 3 176 355 B1. The content of the disclosure of this document with respect to the embodiment of the door leaf and the joint arrangements is hereby incorporated by express reference into this description.

Rollup doors, in which the door leaf forms a multilayered coil above the wall opening in the open position, can also be implemented in the form of so-called high-speed doors, in the case of which the door leaf consists, similarly as with sectional doors, of a plurality of door leaf elements articulated with one another with respect to joint axes extending perpendicular to the predetermined path, the height of which is significantly less in the direction of the predetermined path than in the case of sectional doors, however. Such doors are described, for example, in DE 10 2009 017 767 A1. The content of the disclosure of this document with respect to the design of the door leaf and the articulation of the door leaf elements is hereby incorporated by express reference into this description.

In all above-explained doors, guide rollers are used to guide the door leaf movement, which are typically attached to the door leaf and/or rotatably mounted on roller axes extending perpendicular to the predetermined path and approximately in parallel to the door leaf plane in the closed position, and which are accommodated in fixedly arranged guide rails, wherein the course of the guide rails defines the predetermined path. When the doors just described are used, in particular at high speeds of the door leaf movement, i.e., in the case of so-called high-speed doors, significant noise generation frequently occurs. Furthermore, significant mechanical strain of the guide arrangement is observed.

In consideration of the above-described problems in the prior art, the invention is based on the object of providing doors movable with low wear and less noise generation.

According to the invention, this object is achieved by a refinement of doors of the type mentioned at the outset which is essentially characterized in that the guide arrangement has at least one guide web, which is fixedly arranged with respect to the wall opening and extends along the predetermined path, having two outer boundary surfaces and at least two guide devices fastened on the door leaf, wherein a first outer boundary surface of the guide web forms a guide surface for a first guide device, and the second outer boundary surface of the guide web forms a second guide surface for a second guide device.

This invention originates from the finding that the high noise generation established in the prior art and the observed mechanical wear are primarily to be attributed to the fact that when a guide roller is accommodated in a guide rail, a large amount of play has to be maintained between guide roller and guide rail to ensure interference-free operation. In particular at high door running speeds, this results in a movement of the guide roller in a direction perpendicular to the predetermined path, in the course of which the guide roller strikes against inner boundary surfaces of the guide rail. This not only results in significant noise generation, but rather also in a correspondingly high mechanical load of the guide arrangement.

This deficiency is remedied in doors according to the invention in that the guide device does not interact with inner boundary surfaces of a guide rail, but rather with outer boundary surfaces of a guide web. A corresponding arrangement can be embodied having significantly less play. In this manner, both the noise generation and also the mechanical wear can be reduced. It is accepted in this case that a guide of the door leaf movement upon use of a guide web having outer guide surfaces requires two guide devices or a plurality of guide devices, each of which interacts with an outer guide surface of the guide web.

In one preferred embodiment of the invention, at least one guide device has a guide roller rotatably mounted with respect to a roller axis extending perpendicular to the predetermined path and extending approximately in parallel to the door leaf in the closed position, which rolls on a guide surface of the door leaf during a door leaf movement.

Particularly reliable guiding of the door leaf movement can take place if the guide surfaces of the guide web are arranged approximately parallel to one another and at a distance from one another in a direction extending perpendicular to the guide surfaces. With this arrangement of the guide surfaces, the guide web can be arranged between the guide devices, in particular between two guide rollers, if their roller axes are spaced apart from one another in a direction extending perpendicular to the guide surfaces and preferably extend approximately in parallel to one another. Overall, reliable and nearly play-free guiding of the door leaf movement is thus achieved, which contributes to reducing the noise generation and the wear.

The assembly of doors according to the invention can be simplified while maintaining the required dimensional accuracy if two guide devices, which accommodate the guide web between them and form a guide set in the assembled state, are mounted on a common carrier, wherein the common carrier can preferably be removably attached to the door leaf on its side facing away from the guide devices. This arrangement enables the use of prefinished assemblies, consisting of carrier and guide devices, which can be attached to the door leaf without changing the distance between the guide devices, in particular between the roller axes of the guide rollers.

If the predetermined path has a curved section, it has proven to be particularly expedient in this case if the carrier is attached to the door leaf rotatably with respect to a rotational axis possibly extending in parallel to the roller axes and/or displaceably with respect to a translational axis possibly extending in parallel to the roller axis. Assembly inaccuracies can thus be compensated for. Such an attachment can be implemented particularly simply in manufacturing if a fastening element for attaching the common carrier to the door leaf is embodied in the form of a fastening bolt possibly extending approximately in parallel to the roller axes and a fastening element in the form of a receptacle designed to accommodate the fastening bolt, preferably embodied in the form of a sleeve, wherein one fastening element is arranged on the carrier and one fastening element is arranged on the door leaf.

In doors according to the invention, the door leaf movement can be further stabilized with further reduction of the noise generation and the mechanical wear if a sliding part is provided, which is arranged between the guide devices, in particular between the roller axes of the guide rollers arranged on the common carrier and is preferably fastened on the common carrier, and which can be applied to a sliding surface of the guide webs arranged between the guide surfaces. In this manner, an offset of the door leaf in a direction possibly extending in parallel to the roller axes can be counteracted by contact of the sliding part on the contact surface. For this purpose, sliding parts are preferably provided in the region of the lateral edges of the door leaf opposite to one another, which can be applied to sliding surfaces of the guide webs arranged in the region of these lateral edges. The door leaf is then accommodated between the guide webs and is prevented from a movement in a direction extending perpendicular to the predetermined path, on the one hand, by the guide webs accommodated between the guide devices and, on the other hand, by the sliding parts coming into contact on the sliding surfaces of the guide webs.

The invention can particularly advantageously be used in doors in which joint arrangements are provided in the region of the lateral edges of the door leaf extending approximately in the direction of gravity in the closed position, each of which has a plurality of joint links articulated with one another with respect to joint axes extending perpendicular to the lateral edges and approximately in parallel to the door leaf plane. In this embodiment, a carrier having two guide devices can be attached to at least one, preferably to each joint link in such a way that the guide devices are arranged on the side of the joint link facing away from the door leaf and the guide web is arranged between the guide devices.

The door leaf itself can have a plurality of door leaf members articulated with one another with respect to hinge axes extending perpendicular to the predetermined path. In this case, the door leaf members can be connected to one another via separate joints. Additionally or alternatively, however, articulating the door leaf members with one another with the aid of joint arrangements attached in the region of the lateral edges of the door leaf is also considered.

The door leaf members can have a shell containing an insulating material, such as polyurethane foam. The metal shell can be produced, for example, by cold forming of metal strips. The insulating material can be accommodated between an outer metal shell forming an outer boundary surface of the door leaf member and an inner shell forming an inner boundary surface of the door leaf member. The insulating material can essentially completely fill the cavity between the two shells of the door leaf member.

Additionally or alternatively to door leaf members articulated with one another, the door leaf of doors according to the invention can be formed at least in sections from a flexible material, such as a plastic film. In this case, the joint arrangements can be coupled to the joint arrangements via stabilization arrangements extending perpendicularly to the lateral edges of the door leaf, as specified in EP 3 176 355 B1.

As already explained above, the invention can be implemented particularly advantageously in so-called rollup doors, in which the door leaf forms a multilayered coil in the open position. In such doors, the guide web has a section preferably extending approximately in the direction of gravity and extending linearly approximately in parallel to the lateral edges of the door leaf in the closed position, which merges at its upper end into a spiral-shaped revolving section. In this case, two guide webs arranged in the region of the opposing lateral edges are expediently provided.

Guiding the door leaf movement of at least one section of the predetermined path without contact in the region of at least one of the lateral edges of the door leaf is also intended in the scope of the invention. For this purpose, at least one guide device can have a door-leaf-side magnetic field generating device and at least one web-side magnetic field generating device can be associated with the guide web, wherein the magnetic field generating devices are designed to obtain contactless guiding of the door leaf movement along at least one section of the predetermined path in the region of at least one of the opposing lateral edges.

In this case, door-leaf-side magnetic field devices interacting on opposing sides of the guide web with at least one guide surface, in the region of which a magnetic field is generated, which can have either attractive or repulsive interaction with the web-side magnetic field generating device.

In the scope of the invention, guide devices are considered which exclusively consist of suitably activatable electromagnets. However, it has proven to be advantageous for design reasons if at least one magnetic field generating device, preferably at least one door-leaf-side magnetic field generating device, which is thus movable with the door leaf, has at least one permanent magnet.

In one preferred embodiment of the invention, the door-leaf-side magnetic field generating device has two permanent magnets, which are arranged on opposing sides of the guide web and are fixed on a common carrier overlapping a door-leaf-side edge of the guide web. Particularly reliable contactless guiding can be achieved using this arrangement of permanent magnets if the magnetic field lines within the permanent magnets fixed on the holder extend approximately in the same direction and approximately perpendicularly to the door leaf and the carrier at least partially consists of a ferromagnetic material, in particular soft magnetic material.

In this case, unlike poles of the door-leaf-side permanent magnets arranged on opposing sides of the guide web face toward one another. A magnetic field is obtained in the gap between the unlike poles, which can be formed particularly strongly due to recirculation of the field lines in the ferromagnetic holder. If a web-side magnetic field generating arrangement, for example, web-side permanent magnets having suitable polarization, is arranged within the [word missing] between the unlike poles of the door-leaf-side permanent magnets, the door-leaf-side permanent magnets are repelled in opposing directions from the web-side permanent magnets and reliable contactless guiding is achieved. In the event of a deflection of the door leaf from the predetermined path in a direction extending perpendicular to the door leaf plane, the repulsive forces are strengthened in the region of at least one door-leaf-side permanent magnet, so that the contact between door-leaf-side and web-side magnetic field generating arrangements can be effectively counteracted.

Further securing of the guiding of the door leaf movement can be achieved if guide rollers, guide pins, or similar mechanical guide devices which can be applied to the guide surfaces are also arranged on the side of the door-leaf-side magnetic field generating arrangements facing away from the door leaf. Additional guide rollers can be rotatably mounted on the door leaf with respect to roller axes extending approximately in parallel to the door leaf and perpendicularly to the predetermined path. Mechanical guide devices, such as guide rollers, can be arranged on opposing sides of the guide web, which come into contact with the corresponding guide surface upon a particularly large application of force in a direction extending perpendicular to the door leaf plane, while they are arranged at a distance from the guide surfaces during the desired contactless guiding. In this arrangement, the guide web is thus arranged, on the one hand, between the door-leaf-side magnetic field generating arrangements and, on the other hand, also between the mechanical guide devices attached to the door leaf, such as the rotatably mounted guide rollers and/or the guide pins. In other embodiments of the invention, the guide rollers, guide pins, or the like can also be arranged on the side of the door-leaf-side magnetic field generating devices facing toward the door leaf.

The web-side magnetic field generating devices can be assembled particularly easily if a groove extending at least along a section of the predetermined path is provided in at least one guide surface, in which a web-side magnetic field generating device can be at least partially accommodated. The web-side magnetic field generating device can be embodied here as a permanent magnet. It is particularly advantageous in this arrangement if the web-side magnetic field generating device is at least partially formed from an elastomer magnet. An elastomer magnet is an elastomer in which hard-magnetic materials are embedded. The magnetic field generating device accommodated in the groove can protrude out of the groove on the side facing away from the groove base.

In all embodiments of the invention having web-side and/or door-leaf-side magnetic field generating devices, it has proven to be expedient if a cleaning device is associated with the guide web and/or the door leaf, wherein the door-leaf-side magnetic field generating devices can be cleaned using the web-side cleaning device, and the web-side magnetic field generating devices can be cleaned using the door-leaf-side cleaning device. The cleaning devices can be implemented, for example, in the form of cleaning brushes.

If the predetermined path has a transition between a section extending essentially linearly and a section extending essentially in a curve, such as a transition between a linearly extending section and a spiral-shaped revolving section, it has proven to be particularly expedient if a web-side magnetic field generating device for generating particularly large fields is provided in the region of this transition, because particularly large forces occur in this transition region during the door leaf movement, which are to be absorbed in terms of contactless guiding by correspondingly dimensioned magnetic field generating devices and their interaction with the door-leaf-side magnetic field generating devices. The web-side magnetic field generating devices designed to generate particularly large fields can be, for example, sintered hard magnets.

On the other hand, at least one magnetic field generating device, preferably at least one web-side magnetic field generating device, can have an electromagnet arrangement which is preferably associated with a control unit.

Designing the control device to generate a magnetic field traveling along at least one section of the predetermined path is also considered. Not only contactless guiding of the door leaf movement, but rather also a magnetic drive effectuating the door leaf movement can possibly also be implemented.

Additionally or alternatively, effectuating an attractive interaction between the magnetic field generating devices by suitable activation of the electromagnets upon reaching the closed position is also intended.

In one particularly preferred embodiment of the invention, the guiding of the door leaf movement is achieved using door-leaf-side and web-side magnetic field generating devices, which are preferably implemented by permanent magnets, wherein electromagnets are additionally provided, which cause an attractive interaction with the door-leaf-side magnetic field generating devices upon reaching the closed position, so that by switching on the corresponding electromagnets, a seal function can be produced between door leaf and a frame or a door frame. In this case, bistable arrangements are preferably used, in which the seal function can also be ensured without energizing the electromagnets, while in the second stable position contactless guiding can be ensured with the aid of the permanent magnets without energizing the electromagnets.

In a method for producing a door having magnetic field generating devices, it has proven to be particularly advantageous if magnetized elements, which at least partially consist of hard magnetic material, are attached to the guide web and/or the door leaf and only magnetized thereafter. Interference with the assembly due to the attractive interaction of the permanent magnets with metallic components of the door is thus avoided.

BRIEF DESCRIPTION OF THE DRAWINGS

The invention is explained hereinafter with reference to the drawing, to which reference is expressly made with respect to all details essential to the invention and not highlighted further in the description. In the drawing.

DETAILED DESCRIPTION

Figure 1:
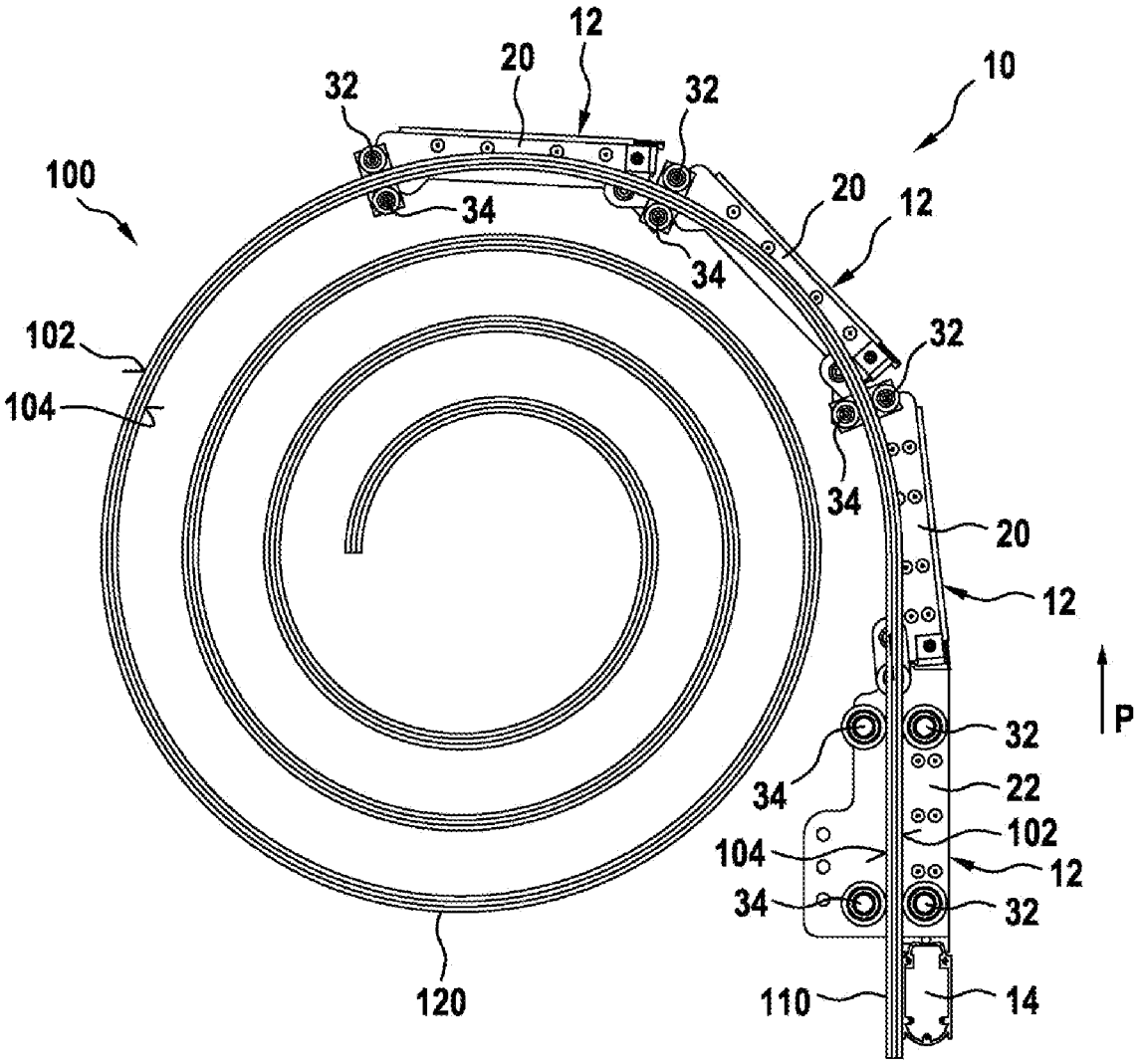
FIG. 1 shows a side view of a door according to the invention upon reaching the open position.

The door illustrated in FIG. 1 comprises a door leaf, denoted as a whole by 10, and a guide web, denoted as a whole by 100, wherein a guide web 100 is provided in each case in the region of both lateral edges of the door leaf, and the door leaf 10 is accommodated between the guide webs. The door leaf 10 consists of a plurality of door leaf members 12 articulated with one another with respect to joint axes extending perpendicularly to the direction extending through the path predetermined by the guide web 100. The guide web 100 has a section 110, which extends approximately in the direction of gravity in parallel to the lateral edges of the door leaf 10 in the closed position, and which merges at its upper end into a spiral-shaped revolving section 120. As indicated in FIG. 1, the door leaf 10 is wound in the open position with the aid of the spiral-shaped section 120 of the guide web 100 into a multilayered coil. Guide rollers 32 and 34 attached to the lateral edges of the door leaf members 12 are provided for guiding the door leaf movement. The guide rollers 32 and 34 form guide roller pairs, between which the guide web 100 is accommodated.

The articulation of the door leaf members 12 is carried out with the aid of joint arrangements having a plurality of joint links 20, wherein each joint link 20 is placed on an end face of a door leaf member 12. The guide rollers 32 and 34 are placed on the joint links 20 or 22, respectively, in such a way that they are arranged on the side of the joint links facing away from the door leaf. The trailing joint link during an opening movement indicated by the arrow P is equipped with a total of four guide rollers 32 and 34, which form two guide roller pairs. The guide rollers of a guide roller pair are spaced apart from one another in a direction perpendicular to the direction extending through the guide web 100, wherein the roller axes extend approximately in parallel to one another. The guide web 100 has outer boundary surfaces or guide surfaces 102 or 104 opposing one another, wherein a first guide roller 32 of each guide roller pair comes into contact on a first guide surface 102 of the guide web 100 and rolls thereon, while a second guide roller 34 of each guide roller pair presses against a second guide surface 104 and rolls thereon. The guide web is thus arranged between the guide rollers 32 and 34 of the individual guide roller pairs.

A bottom seal 14, which presses against the bottom of the wall opening to be closed using the door leaf 10 in the closed position, is arranged on an edge trailing during an opening movement of the door leaf member trailing during the opening movement. As shown in FIG. 1, the guide rollers 32 and 34 of the guide roller pairs can press without play against the guide surfaces 102 and 104 of the guide web.

Figure 2:
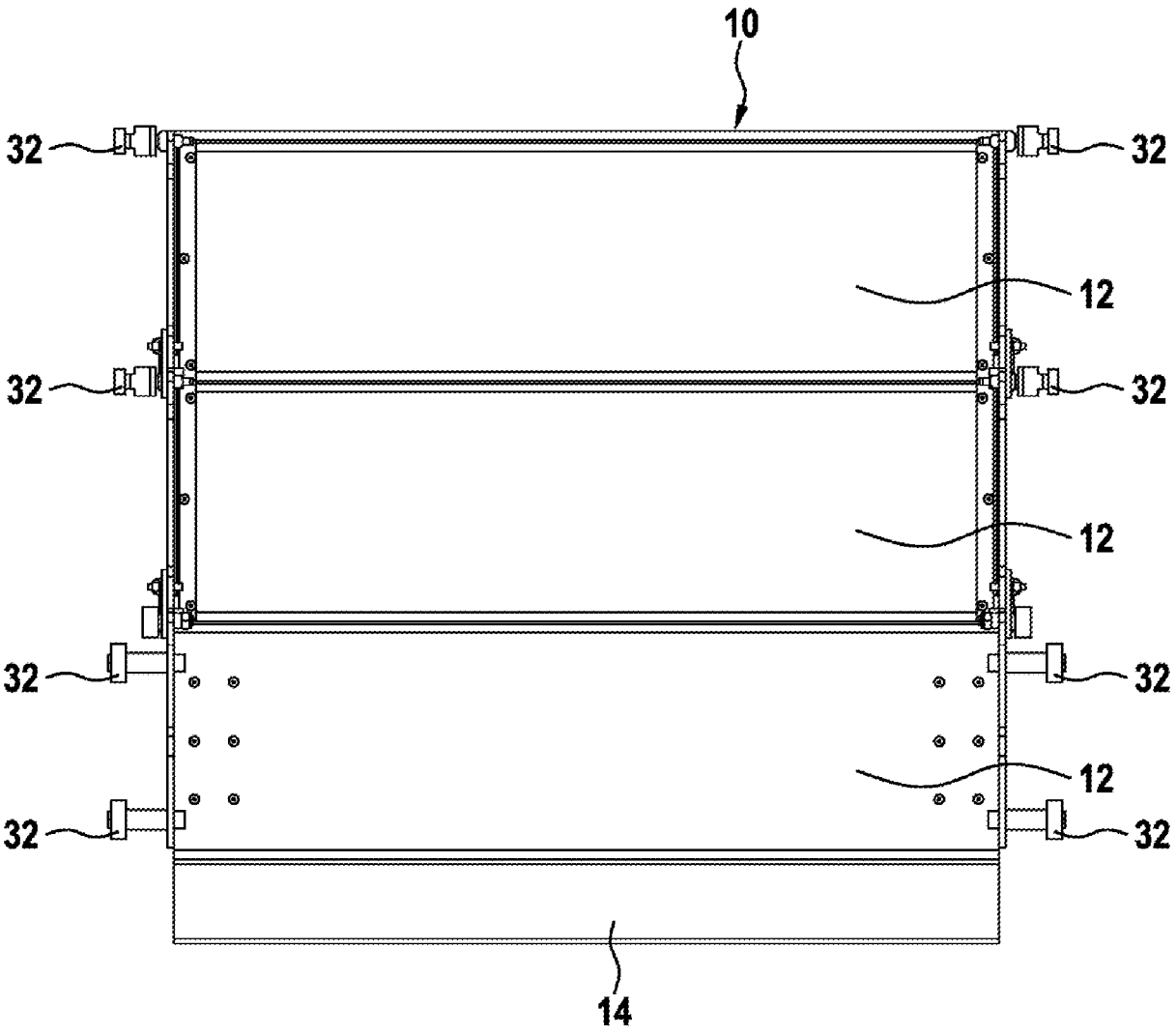
FIG. 2 shows an illustration of a door according to the invention in the closed position.
Figure 2:
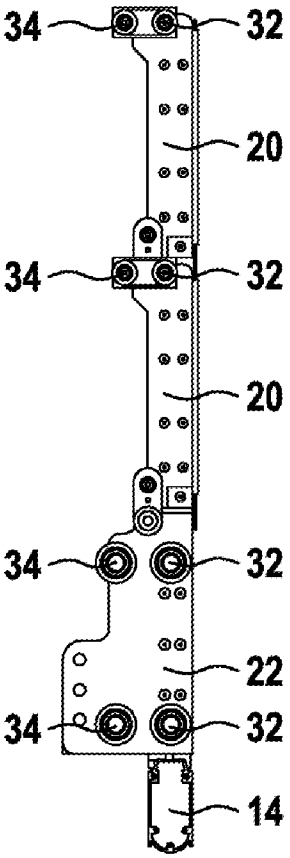

As can be seen in FIG. 2, guide rollers 32 and 34 are arranged on the two opposing lateral edges of the door leaf 10, which interact with guide webs 100 (not shown in FIG. 2), which are fixedly attached in the region of these lateral edges.

Figure 3:
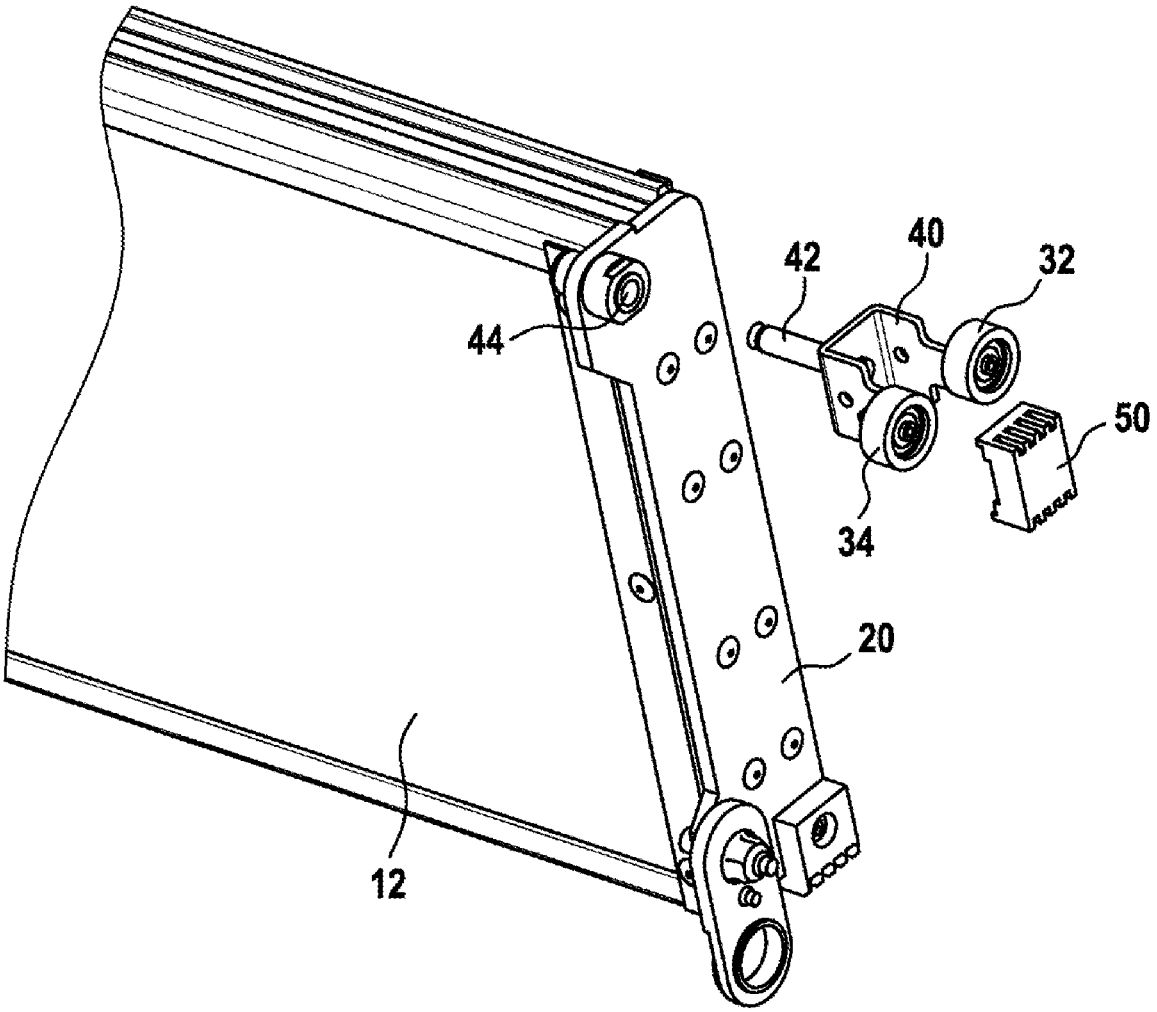
FIG. 3 shows an exploded view of a door leaf member of a door according to the invention.

The assembly of a door according to the invention is schematically indicated in FIG. 3. The guide rollers 32 and 34 are rotatably mounted on a common carrier 40 with respect to roller axes extending in parallel to one another and approximately perpendicular to the predetermined path. The roller axes of the guide rollers 32 and 34 are spaced apart from one another in a direction extending perpendicular to the predetermined path and perpendicular to a main plane of the door leaf member. The common carrier 40 has, on its side facing away from the guide rollers 32 and 34, a fastening bolt 42, which extends in a direction extending in parallel to the roller axes and is insertable into a receptacle 44 provided in the region of a joint link 20 placed on an end face of the door leaf member 12. The carrier 40 is held thereon so it is rotatable as a whole with respect to the joint link 20 and the door leaf member 12. The carrier 40 does not have to be locked in the axial direction, because a carrier is provided on each lateral edge of the door leaf member 12 and this carrier 40 is accommodated together with the door leaf member between corresponding, fixed guide webs 100.

To further reduce the axial play, a sliding part 50 is provided, which can be attached to carrier 40 between the guide rollers 32 and 34. In the event of an offset of the entire arrangement, consisting of door leaf member 12, joint link 20, holder 40, and guide rollers 32 and 34, in parallel to the axis of the bolt 42, the sliding part 50 comes into contact on a sliding surface of the guide web 100, which is arranged between the guide surfaces 102 and 104 or connects the guide surfaces 102 and 104 of the guide web 100 to one another.

Figure 4:
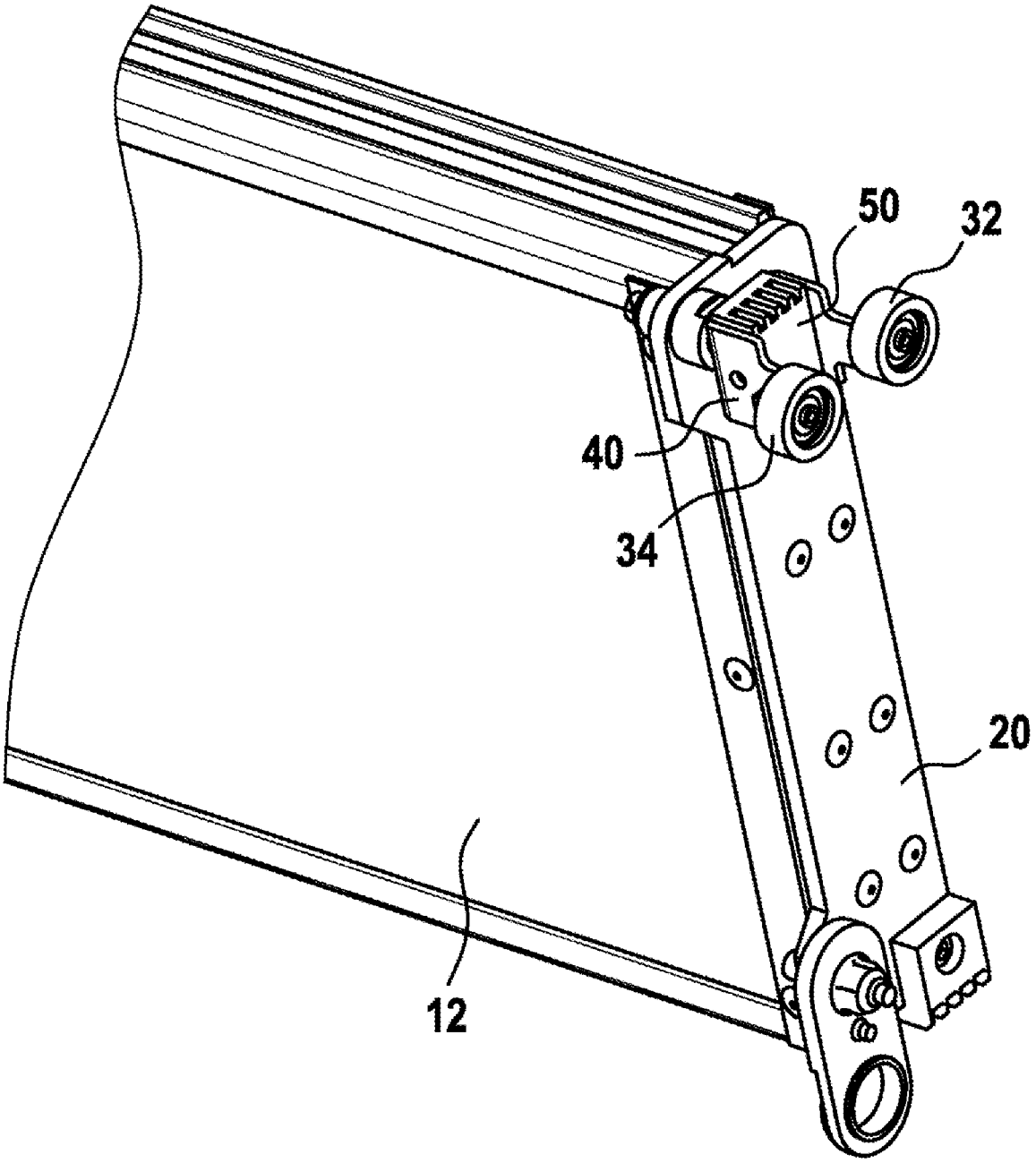
FIG. 4 shows the door leaf member according to FIG. 3 in the assembled state.

In FIG. 4, the door leaf member 12 is shown with the carrier 40 in the assembled state.

Figure 5:
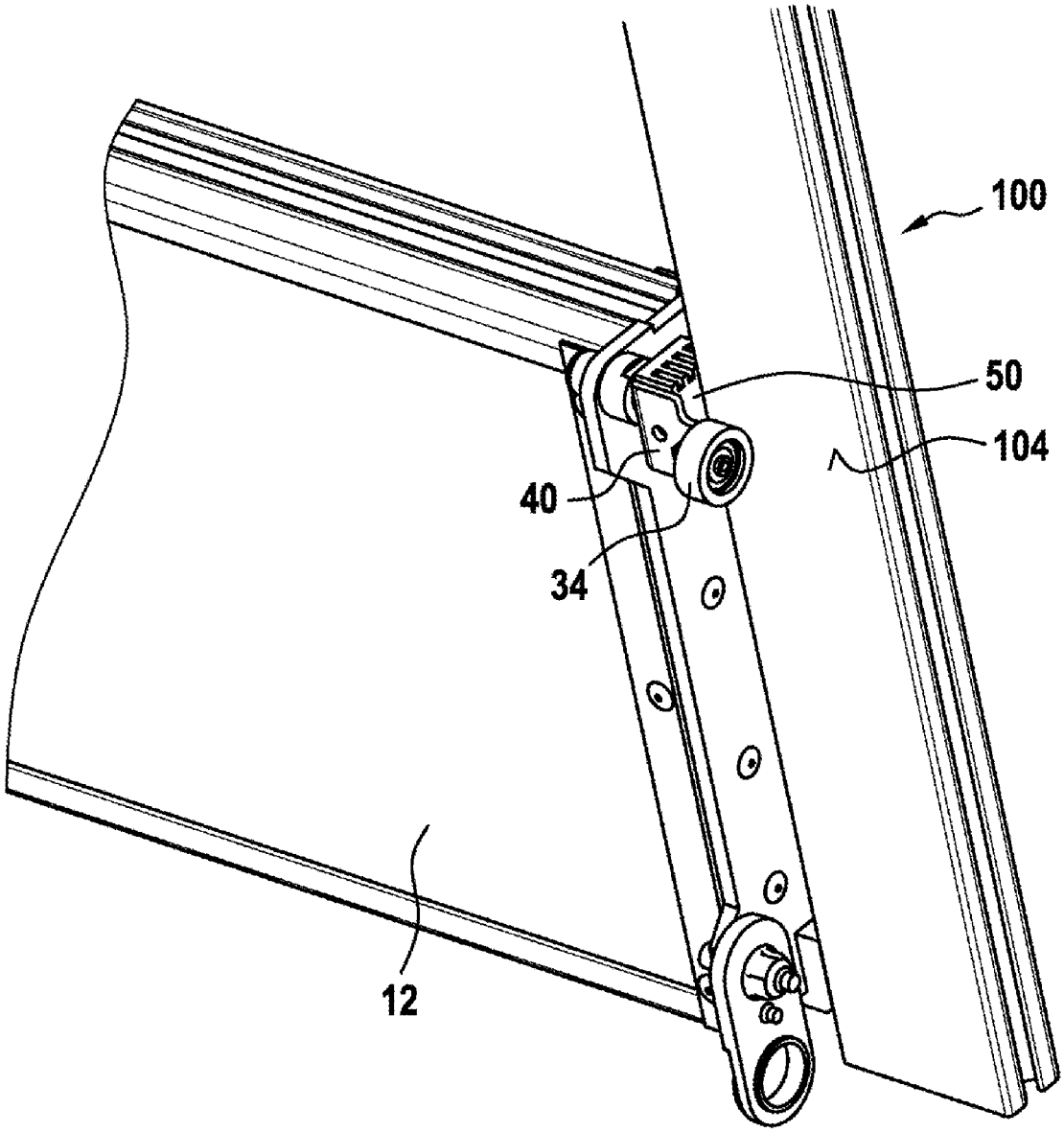
FIG. 5 shows a perspective illustration of the door leaf member according to FIG. 4.

FIG. 5 shows the door leaf member illustrated in FIGS. 3 and 4 after the assembly between the guide webs 100. It can be seen how the guide roller 32 presses against a guide surface 102 of the guide web 100. The guide roller 34 (also not shown in FIG. 5) presses against the guide surface (not shown) opposing the guide surface 102. The guide web 100 can be accommodated substantially without play between the guide rollers 32 and 34. On the one hand, precise guiding of the door leaf movement is thus achieved and, on the other hand, noise generation is counteracted and the mechanical strain of the guide arrangement is reduced.

Figure 6:
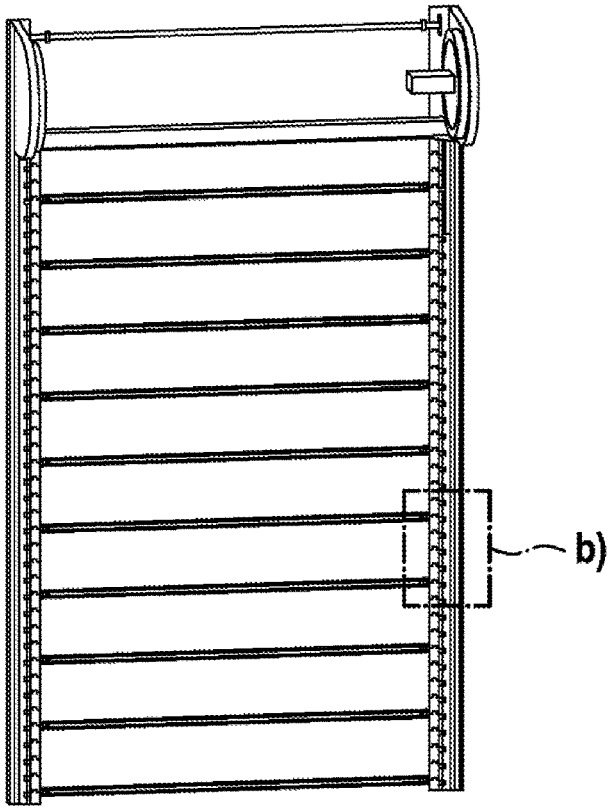
FIG. 6 shows a first embodiment of a door according to the invention having magnetic guide.
Figure 6:
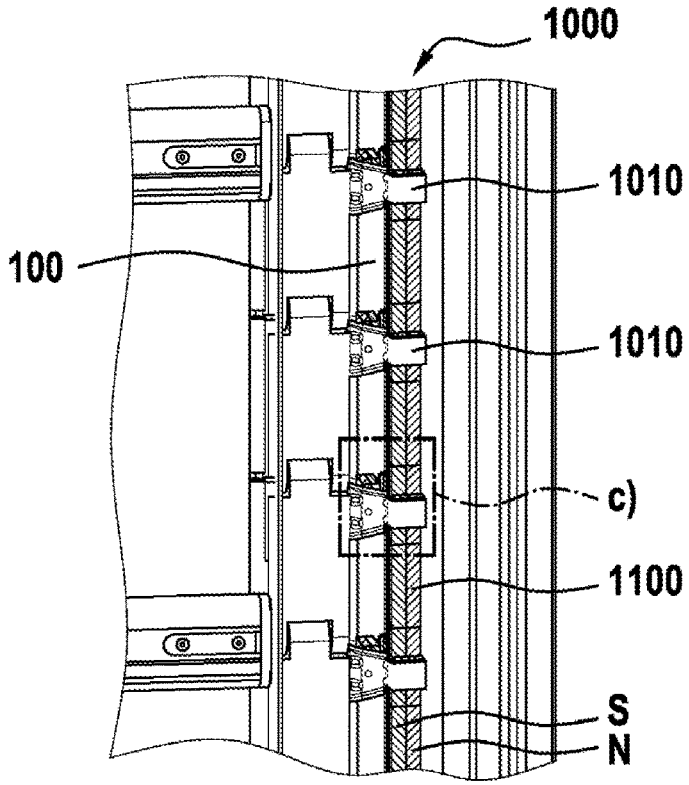
Figure 6:
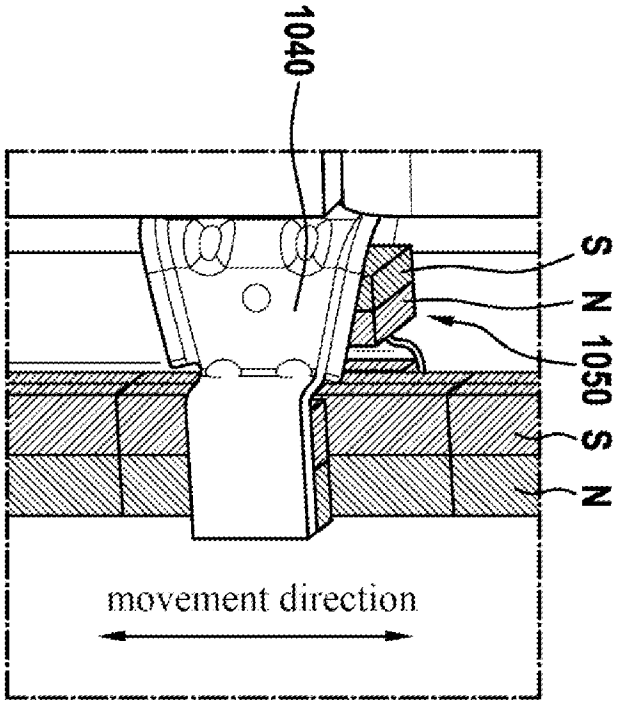
Figure 6:
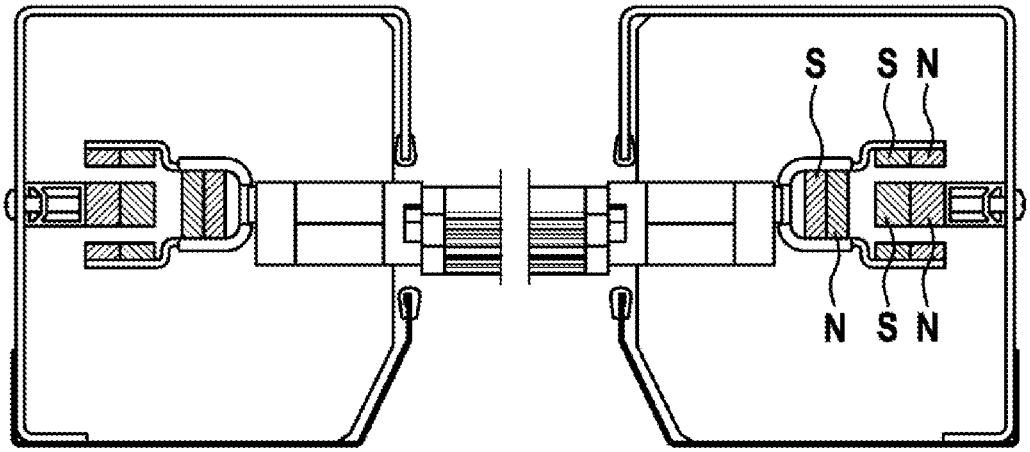

The embodiment of the invention illustrated in FIG. 6 essentially differs from the embodiments explained on the basis of FIGS. 1 to 5 in that instead of a roller guide, contactless magnetic guiding of the door leaf movement is provided. For this purpose, the door illustrated in FIG. 6 is equipped with a magnetic guide arrangement 1000, which has door-leaf-side magnetic field generating devices 1010 and web-side magnetic field generating devices 1100. The door-leaf-side magnetic field generating devices are arranged similarly to the guide rollers on opposing sides of the guide web 100. The door-leaf-side magnetic field generating device is formed from permanent magnets, the field lines of which extend inside the magnets themselves in parallel to the door leaf plane. The web-side magnetic field generating device 1100 is also formed from permanent magnets, the field lines of which also extend within the magnets themselves in parallel to the door leaf plane.

The attachment of the permanent magnets is selected so that regions of the same polarization are located opposing and thus repulsive forces act between web-side magnetic field generating device and door-leaf-side magnetic field generating device. The permanent magnets of a single door-leaf-side magnetic field generating device are attached similarly to the guide rollers on a common carrier 1040, so that they are arranged on opposing sides of the guide web and the web-side magnetic field generating device attached thereon. The polarization of the individual permanent magnets can be seen particularly clearly in FIG. 1*c*). In addition, a lateral positioning magnet 1050 is provided, which is also polarized in such a way that a repulsive force is induced between the door-leaf-side positioning magnet and the web-side magnetic field generating device. The positioning magnet 1050 assumes the same function as the sliding part 50 in the embodiments of the invention explained on the basis of FIGS. 1 to 5. Replacing the positioning magnet with a sliding part is also considered.

In FIG. 6, FIG. 6*b*) shows the detail indicated in FIG. 6*a*), FIG. 6*c*) shows the detail indicated in FIG. 6*b*), and FIG. 6*d*) shows a sectional illustration along a plane of section extending perpendicularly to the door leaf movement direction.

Figure 7:
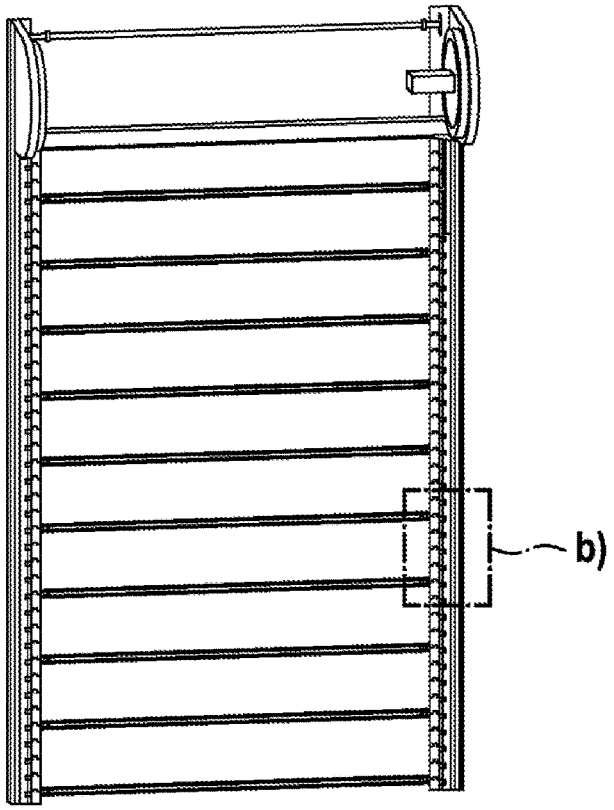
FIG. 7 shows a second embodiment of a door according to the invention having magnetic guide.
Figure 7:
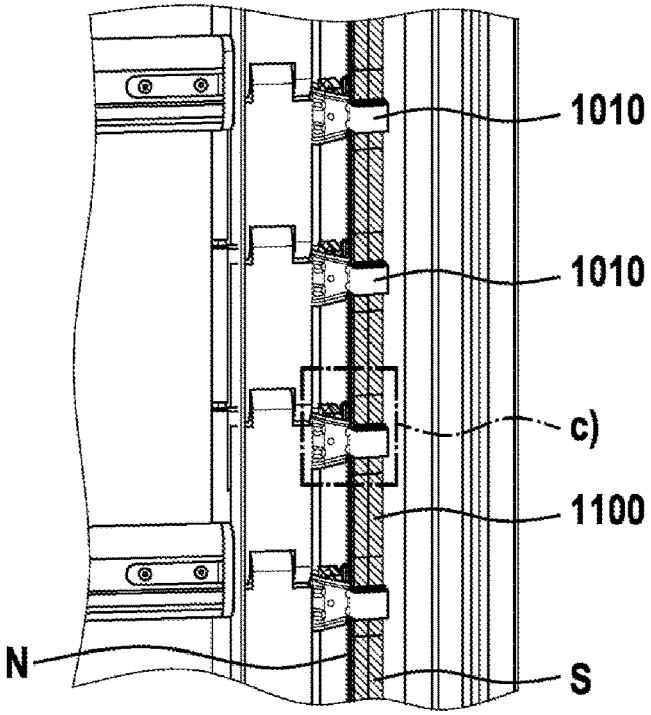
Figure 7:
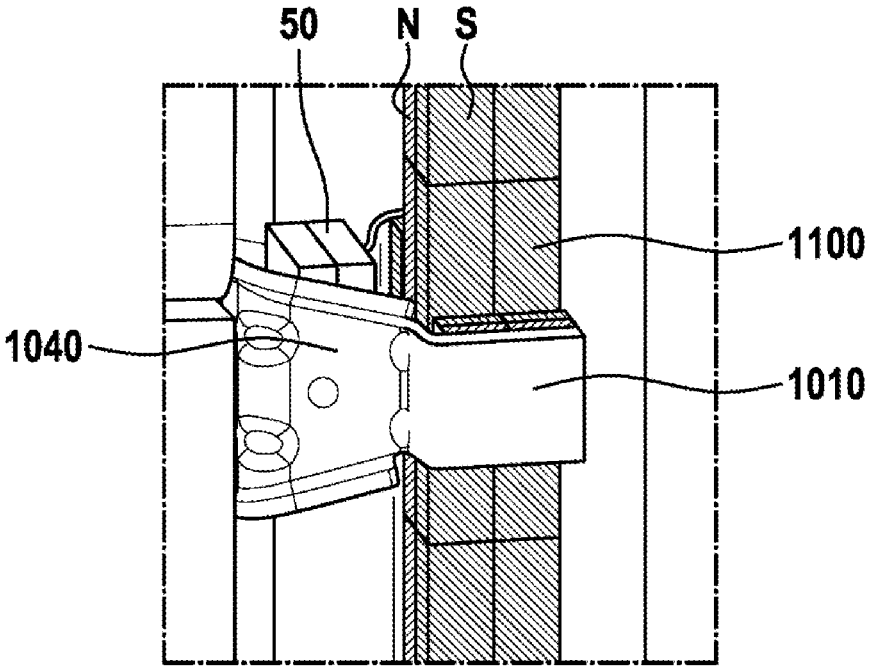
Figure 7:
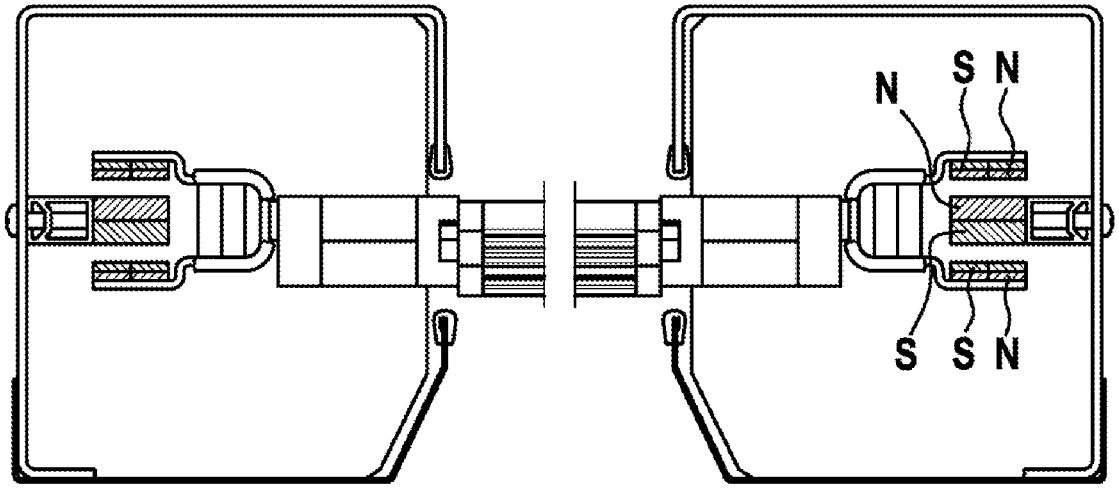

The embodiment of the invention illustrated in FIG. 7 essentially differs from the embodiment explained on the basis of FIG. 6 in that the field lines of the individual magnetic field generating devices extend within the permanent magnets in a direction extending perpendicular to the door leaf movement direction. Furthermore, instead of a positioning magnet, a sliding part 50 is provided. In FIG. 7, the same reference numerals are used to identify the individual components of the magnet guide arrangement 1000 as in FIG. 6.

Figure 8:
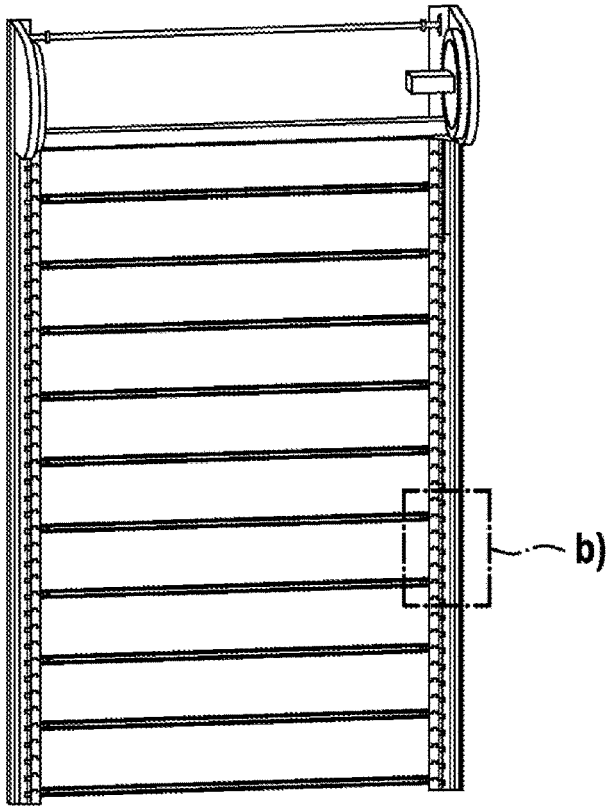
FIG. 8 shows a third embodiment of a door according to the invention having magnetic guide.
Figure 8:
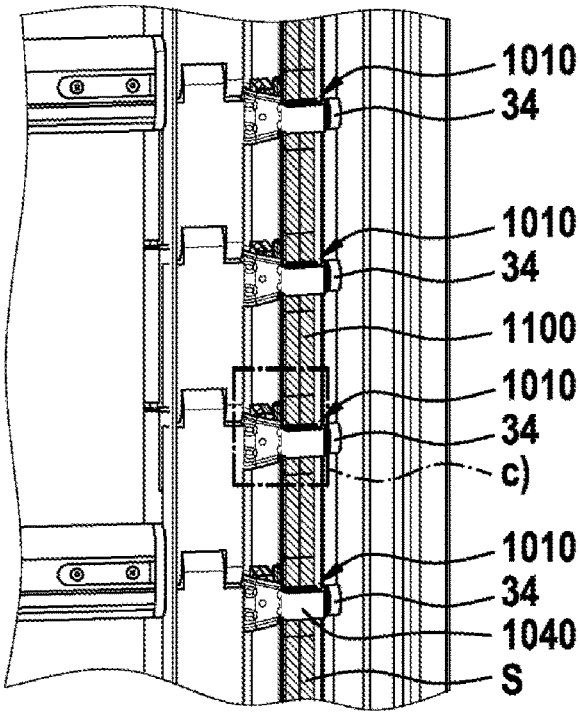
Figure 8:
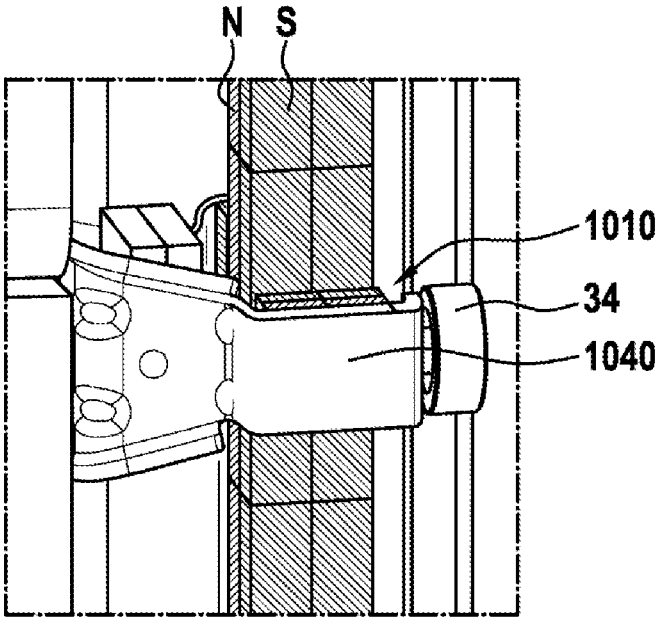
Figure 8:
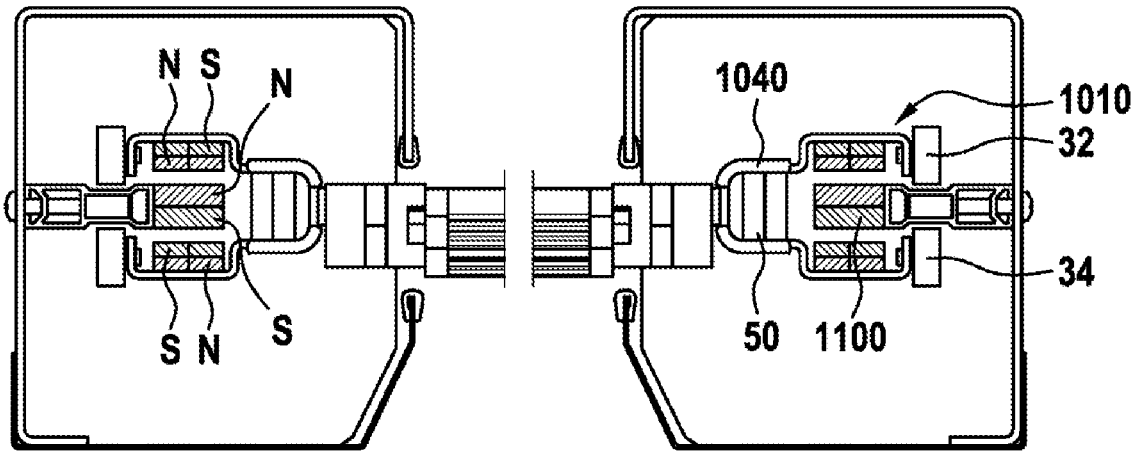

A combination of the contactless magnetic guide according to FIG. 7 with a roller guide according to FIGS. 1 to 5 is illustrated in FIG. 8. A combination of magnet technology and guide roller technology can be advantageous if above-average strains are to be provided, which can be absorbed via the rollers without damage occurring to the magnetic field generating devices. It is also conceivable that the contactless magnet technology is only used in individual sections of the movement path, for example, in the linearly extending sections, while a mechanical support with the aid of the guide rollers 32 and 34 is used in curved sections of the guide path, for example, in the region of the spiral-shaped revolving sections.

Figure 9:
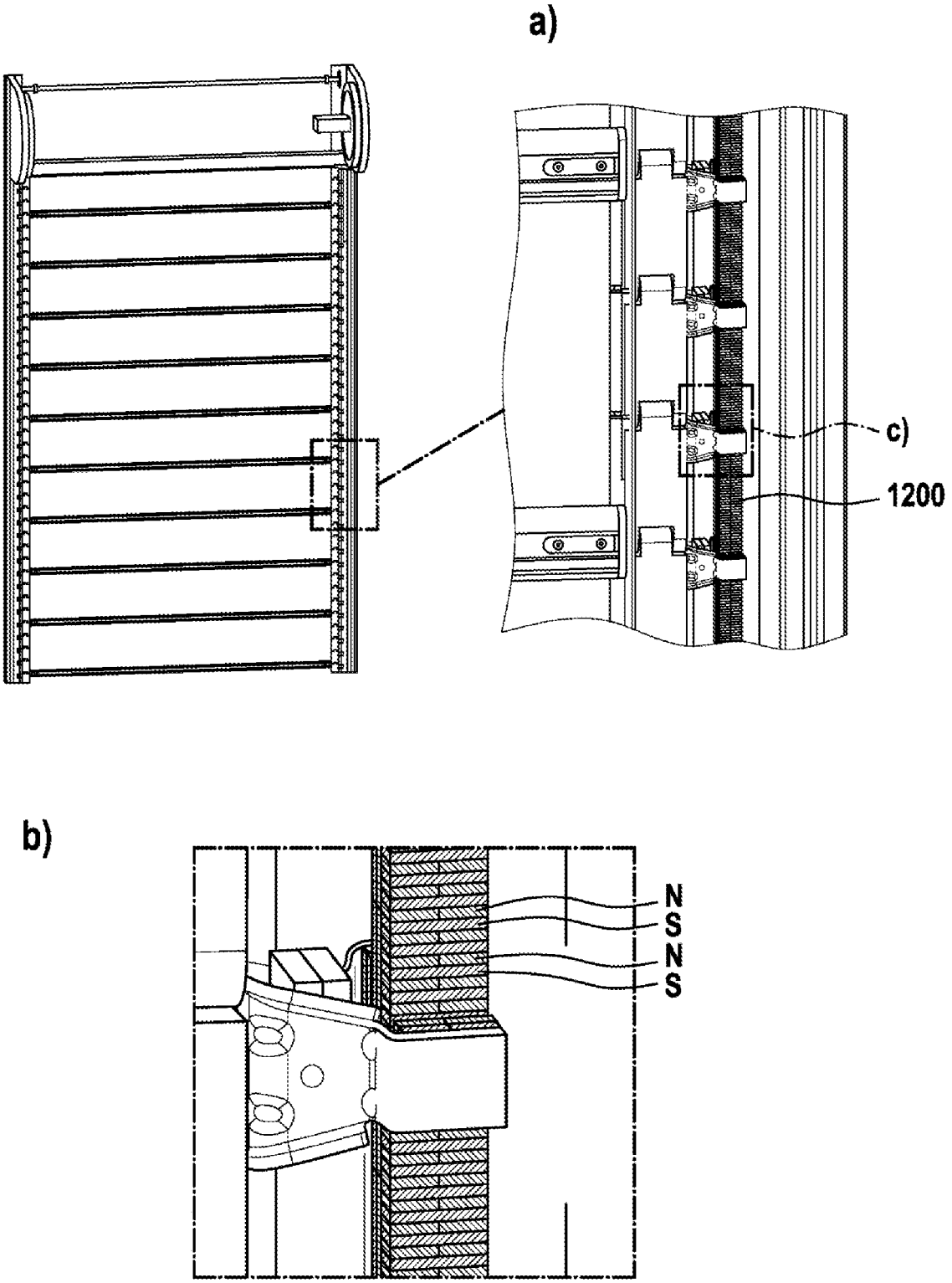
FIG. 9 shows a fourth embodiment of a door according to the invention having magnetic guide.
Figure 9:
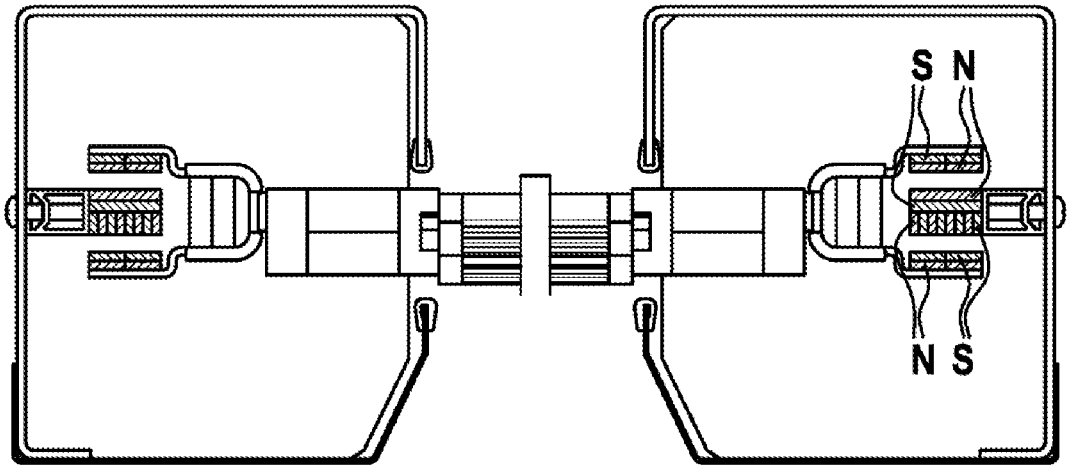
Figure 9:
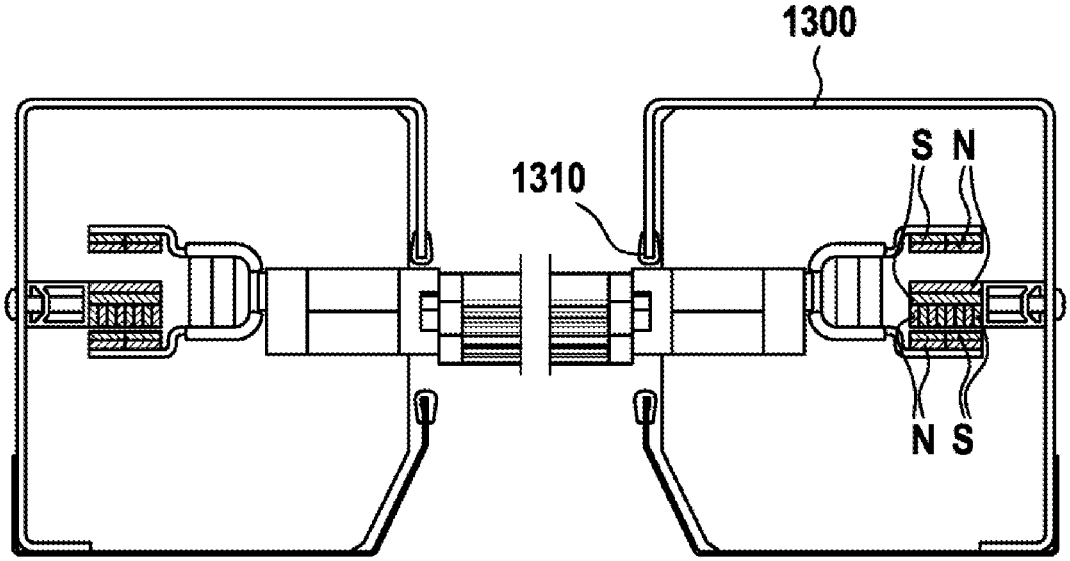

In the embodiment of the invention explained on the basis of FIG. 9, the door-leaf-side magnetic field generating device 1010 and the sliding part 50 are designed just as in the embodiment of the invention explained on the basis of FIG. 8. The web-side magnetic field generating device is embodied in the form of an electromagnet arrangement 1200, however. As in the embodiment explained on the basis of FIG. 8, a sliding part 50 is provided as a positioning aid, as is also the case in the embodiment of the invention explained on the basis of FIGS. 1 to 5. During a door leaf movement, the electromagnet arrangement 1200 can be operated with the aid of a suitable control unit so that a repulsive force occurs between electromagnet arrangement and door-leaf-side permanent magnets.

Upon reaching the lower end position, the electromagnet arrangement can either be turned off or operated with reverse polarization. The door leaf is thus displaced in the direction toward a guide web, which is provided in a housing 1300 and is preferably at least partially jacketed by a sealing material, since the floating state generated by the prior polarization of the electromagnet is canceled out. The repulsive forces of the door-leaf-side magnetic field generating device or the door-leaf-side permanent magnets are then sufficient to displace the door leaf. Alternatively, a polarization can be generated using the electromagnet arrangement such that an attractive force is achieved between door-leaf-side permanent magnets and web-side electromagnet arrangement, which generates the desired displacement of the door leaf in a direction extending in the door leaf movement direction.

An improved sealing function can be achieved in the closed state by this displacement of the door leaf, as indicated at 1310 in FIG. 9*d*). When a door leaf movement is triggered using a suitable control unit, the polarization of the electromagnet arrangement is again switched over such that the floating state is achieved and the door leaf can be guided contactlessly.

Figure 10:
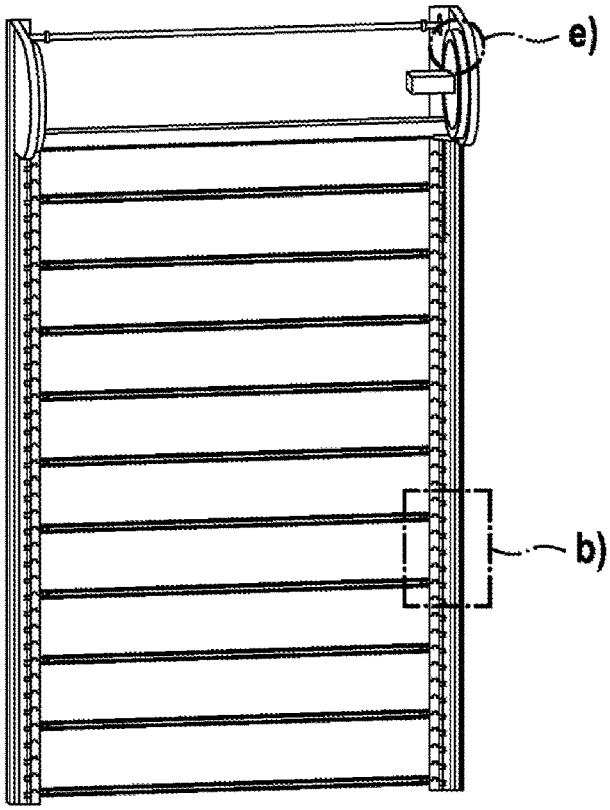
FIG. 10 shows a fifth embodiment of a door according to the invention having magnetic guide.
Figure 10:
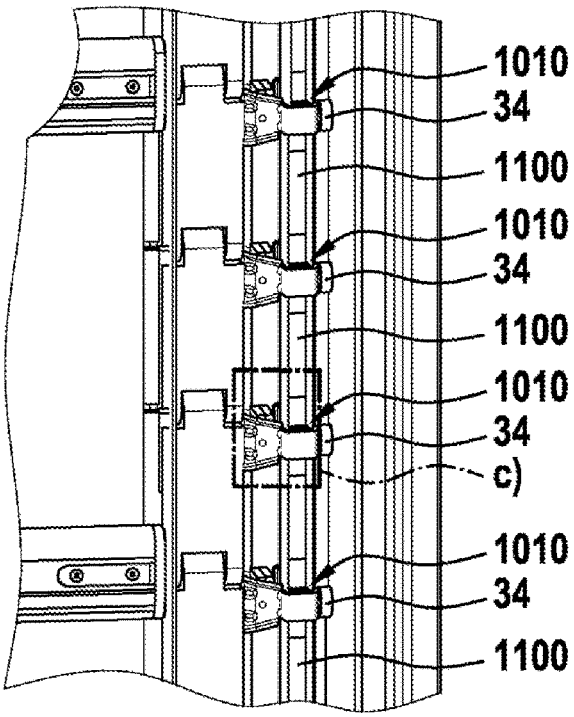
Figure 10:
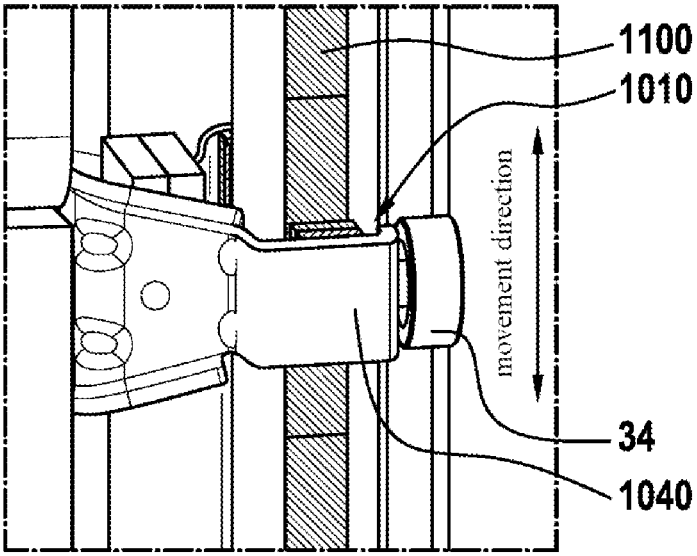
Figure 10:
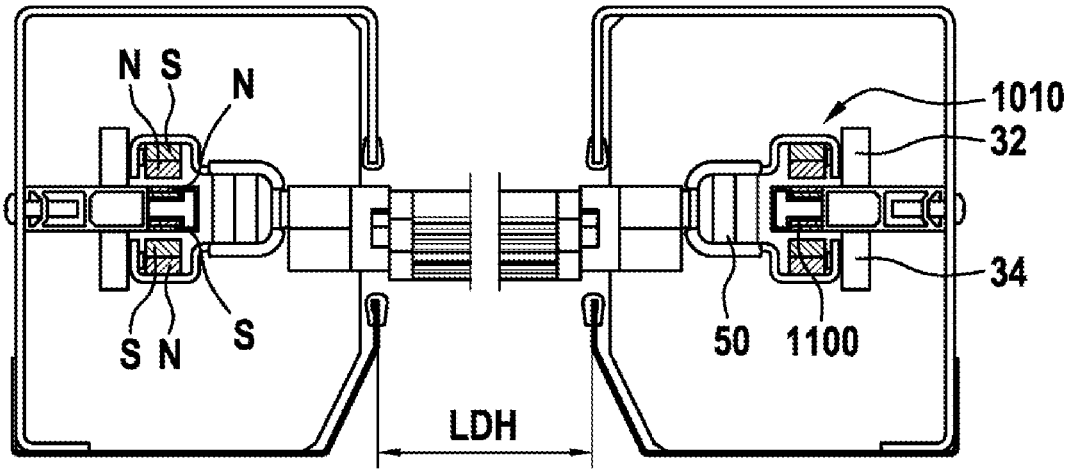
Figure 10:
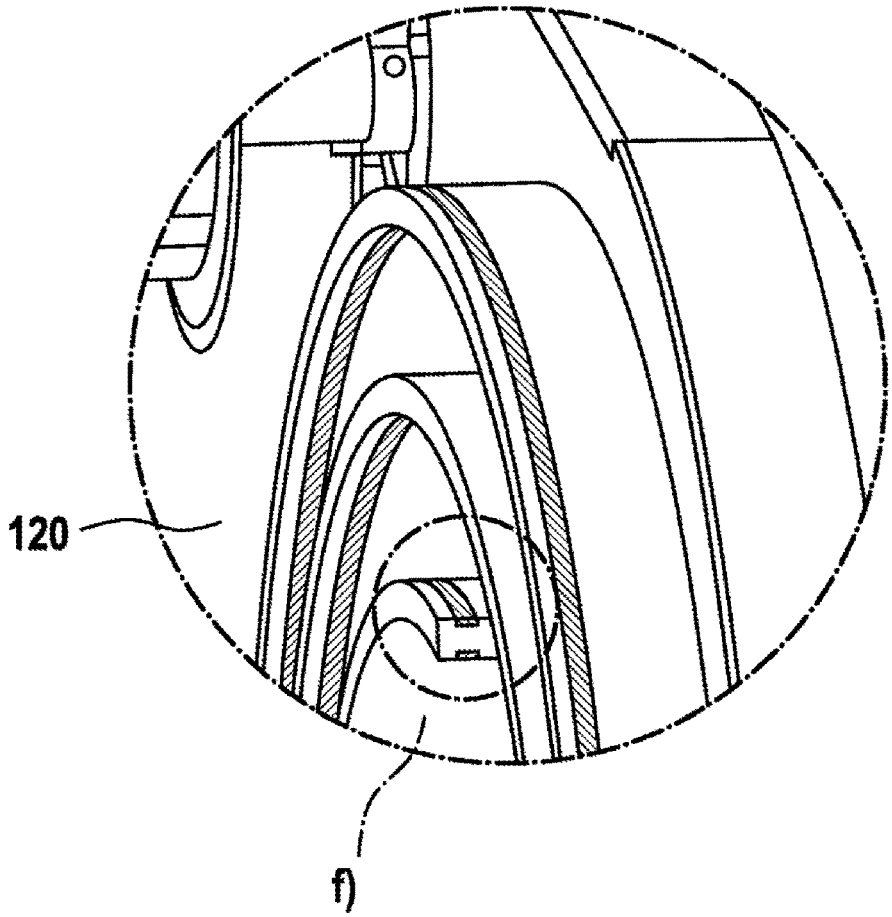
Figure 10:
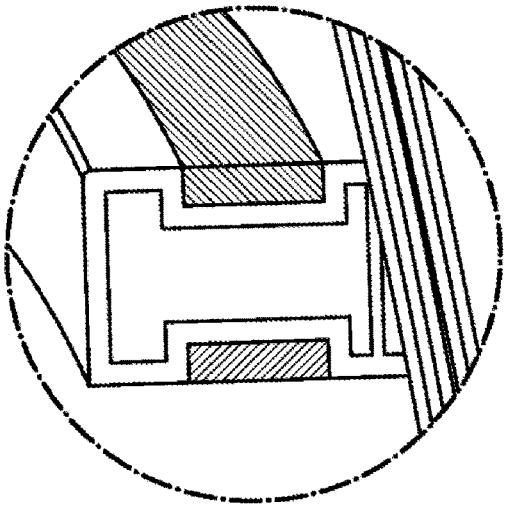

The embodiment of the invention illustrated in FIG. 10 essentially corresponds to the embodiment explained on the basis of FIG. 8. It differs from the embodiment explained on the basis of FIG. 8 in that the web-side magnetic field generating devices 1100 are accommodated in a groove extending in the longitudinal direction of the guide, as can be seen particularly clearly in FIGS. 10*d*) and 10*f*). It can furthermore be seen that the web-side magnetic field generating devices 1100 protrude somewhat beyond the groove on their side facing away from the groove base. Upon production of the web-side magnetic field generating devices from an elastomer magnet, an additional buffer function can thus be achieved. To ensure satisfactory emergency operation, in the embodiment of the invention illustrated in FIG. 10, guide rollers 32 and 34 are provided on the side of the magnetic field generating devices 1010 and 1100 facing away from the door leaf, similarly as in the embodiment explained on the basis of FIG. 8. Such supplementary mechanical guide devices in the form of guide rollers, guide pins, guide bolts, or the like can be provided in all embodiments of the invention.

Furthermore, it has proven to be particularly advantageous in the scope of the invention if the carriers 1040 for the door-leaf-side magnetic field generating devices 1010 are at least partially formed from a ferromagnetic material, in which the field lines of the magnets arranged on opposing sides of the web-side magnetic field generating device are returned, to thus provide a particularly strong magnetic field in the gap between the opposing door-leaf-side permanent magnets.

As is particularly clearly apparent in FIG. 10*e*), the web-side magnetic field generating devices, which are preferably formed in the form of so-called elastomer magnets, are also provided in a spiral-shaped revolving section 120 of the guide web 100. Contactless guiding of the door leaf movement can thus also be achieved in the region of the spiral-shaped section, wherein the supplementary mechanical guide devices can be used particularly advantageously in this region.

The invention is not restricted to the embodiment illustrated on the basis of the drawing. Rather, the use of doors according to the invention in the form of so-called sectional doors is also considered, in which the door leaf is arranged overhead approximately in a horizontal plane in the open position. The invention can also advantageously be used in so-called film doors, in which the door leaf consists of plastic films reinforced with the aid of reinforcing profiles. The guide surfaces of the guide web can also enclose an acute angle with one another. The guide rollers can also be fastened directly on the door leaf members without a joint link interconnected if the articulation between the door leaf members is produced with the aid of separate joints. The holders provided in a door according to the invention for the guide rollers can be produced from steel plate, from diecast aluminum, or from milled steel.

LIST OF REFERENCE NUMERALS

10 door leaf
12 door leaf member

14 bottom seal
20 joint link
22 joint link
32 first guide roller
34 second guide roller
40 roller carrier
42 fastening bolt
44 receptacle
50 sliding part
100 guide web
102 outer boundary surface
104 outer boundary surface
110 lateral section
120 spiral-shaped revolving section
1000 magnetic guide arrangement
1010 door-leaf-side magnetic field generating device
1100 web-side magnetic field generating device
1040 carrier
1050 positioning magnet
1200 electromagnet arrangement
1300 housing

The invention claimed is:

1. A door comprising:

a door leaf movable between an open position, in which it at least partially uncovers a wall opening, and a closed position, in which it at least partially closes the wall opening; and an arrangement for guiding the door leaf movement along a predetermined path between the open position and the closed position wherein the guide arrangement has:

i) two guide webs which are fixedly arranged with respect to the wall opening and extend along at least a section of the predetermined path, said two guide webs being arranged in the region of opposing lateral edges of the door leaf, and each of the two guide webs having two outer boundary surfaces on opposing sides of the guide web; and ii) at least two guide sets fastened on the door leaf in the region of opposing lateral edges of the door leaf, wherein a first guide set of the at least two guide sets includes two guide rollers rotatably mounted with respect to a respective roller axis extending perpendicular to the predetermined path and extending along an axis that extends between the opposing lateral edges of the door leaf, wherein a first outer boundary surface of a first guide web of the two guide webs forms a first guide surface for a first guide roller of the two guide rollers to roll on during door leaf movement, and a second outer boundary surface of the first guide web forms a second guide surface for a second guide roller of the two guide rollers to roll on during door leaf movement;

said door further comprising joint arrangements attached to the door leaf in the region of the lateral edges of the door leaf extending approximately in the direction of gravity in the closed direction, wherein a joint arrangement of the joint arrangements includes a plurality of joint links articulated with one another with respect to joint axes extending perpendicular to the lateral edges of the door leaf and approximately parallel to a plane of the door leaf, wherein:

the first guide set of the at least two guide sets includes a common carrier having the two guide rollers, and the first guide set is attached to at least one joint link of a joint arrangement of the joint arrangements in such a way that the two guide rollers are arranged on a side of the at least one joint link facing away from the door leaf, and the first guide web is arranged between the two guide rollers;

the first guide web includes a linear section which extends approximately in the direction of gravity and extends approximately parallel to the lateral edges of the door leaf in the closed position, and which merges at an upper end of the first guide web into a spiral-shaped revolving section; and the door leaf forms a multi-layered coil in the opened position.

2. The door as claimed in claim 1, wherein first and second guide surfaces of the first guide web are arranged approximately in parallel to one another and spaced apart from one another in a direction extending perpendicularly to the first and second guide surfaces.

3. The door as claimed in claim 1, wherein the roller axes are approximately in parallel to one another.

4. The door as claimed in claim 1, wherein, to attach the common carrier, a first fastening element in the form of a fastening bolt, extending approximately in parallel to the roller axes and a second fastening element in the form of a receptacle designed to accommodate the fastening bolt, preferably embodied in the approximate form of a sleeve, is provided, wherein one of the first or second fastening elements is arranged on the common carrier and another one of the first or second fastening elements is arranged on the door leaf.

5. The door as claimed in claim 1, further including a sliding part, which is arranged between the two guide rollers of the first guide set, wherein the sliding part is fastened on the common carrier, and wherein the sliding part is applicable to a sliding surface of the first guide web between the two guide rollers.

6. The door as claimed in claim 1, wherein the door leaf is formed at least in sections from a flexible material, including a plastic film.

7. The door as claimed in claim 1, wherein the first guide set has a door-leaf-side magnetic field generating device, and a web-side magnetic field generating device that is associated with the first guide web, wherein the magnetic field generating devices are designed to obtain contactless guiding of the door leaf movement along at least one section of the predetermined path in the region of at least one of the opposing lateral edges of the door leaf.

8. The door as claimed in claim 7, wherein the door-leaf-side magnetic field generating device has at least one permanent magnet.

9. The door as claimed in claim 8, wherein the door-leaf-side magnetic field generating device has two permanent magnets arranged on opposing sides of the first guide web, which are fixed on the common carrier.

10. The door as claimed in claim 9, wherein the magnetic field lines extend within the permanent magnets fixed on the holder in approximately a same direction perpendicular to the door leaf, and the common carrier at least partially includes a ferromagnetic material.

11. The door as claimed in claim 9, wherein the control unit is designed to switch off the electromagnet arrangement or to generate an attractive interaction between the door-leaf-side magnetic field generating device and the web-side magnetic field generating device upon reaching the closed position.

12. The door as claimed in claim 7, further comprising a groove, extending at least along a section of the predetermined path, is provided in at least one of the first and second guide surfaces, in which the web-side magnetic field generating device, such as a permanent magnet, including an elastomer magnet, is partially accommodated.

13. The door as claimed in claim 7, wherein the web-side magnetic field generating device has an electromagnet arrangement, with which a control unit is associated.

14. The door as claimed in claim 13, wherein the control unit is designed to generate a magnetic field traveling along at least one section of the predetermined path.

* * * * *